US009611617B2

(12) United States Patent
Knuth

(10) Patent No.: US 9,611,617 B2
(45) **Date of Patent: *Apr. 4, 2017**

(54) SHOVEL WITH PIVOTING BUCKET

(71) Applicant: Harnischfeger Technologies, Inc., Wilmington, DE (US)

(72) Inventor: Jason Knuth, Brookfield, WI (US)

(73) Assignee: Harnischfeger Technologies, Inc., Wilmington, DE (US)

( * ) Notice: Subject to any disclaimer, the term of this patent is extended or adjusted under 35 U.S.C. 154(b) by 2 days.

This patent is subject to a terminal disclaimer.

(21) Appl. No.: 14/697,718

(22) Filed: Apr. 28, 2015

(65) Prior Publication Data

US 2015/0240444 A1 Aug. 27, 2015

Related U.S. Application Data

(63) Continuation of application No. 13/755,228, filed on Jan. 13, 2013, now Pat. No. 9,015,969.
(Continued)

(51) Int. Cl.
*E02F 3/40* (2006.01)
*E02F 3/36* (2006.01)
(Continued)

(52) U.S. Cl.
CPC ..... *E02F 3/3677* (2013.01); *E02F 3/304* (2013.01); *E02F 3/40* (2013.01); *E02F 3/4075* (2013.01);
(Continued)

(58) Field of Classification Search
CPC . E02F 3/304; E02F 3/305; E02F 3/308; E02F 3/425; E02F 3/427; E02F 3/4075;
(Continued)

(56) References Cited

U.S. PATENT DOCUMENTS 1,883,915 A 10/1932 Holcomb
2,185,176 A 1/1940 Bager et al.
(Continued)

FOREIGN PATENT DOCUMENTS

CN 85107742 4/1987
CN 86204530 12/1987
(Continued)

OTHER PUBLICATIONS

Second Office Action from the Australian Intellectual Property Office for Application No. 2015200038 dated Aug. 27, 2015 (2 pages).
(Continued)

*Primary Examiner* — Robert Pezzuto
(74) *Attorney, Agent, or Firm* — Michael Best & Friedrich LLP

(57) ABSTRACT

A mining shovel including a base, a boom, a first member moveably coupled to the boom, a bucket, and a pivot actuator. The base includes a hoist drum for paying out and reeling in a hoist rope. The boom includes a first end coupled to the base and a second end opposite the first end. The hoist rope extends over the second end of the boom. The first member includes a first end and a second end. The bucket is pivotably coupled to the second end of the first member. The pivot actuator moves the bucket relative to the second end of the first member, and the pivot actuator includes a first end coupled to the first member.

33 Claims, 9 Drawing Sheets

Related U.S. Application Data

(60) Provisional application No. 61/592,944, filed on Jan. 31, 2012, provisional application No. 61/593,131, filed on Jan. 31, 2012.

(51) Int. Cl.
*E02F 3/30* (2006.01)
*E02F 3/407* (2006.01)
*E02F 3/42* (2006.01)
*E02F 3/46* (2006.01)

(52) U.S. Cl.
CPC ..... *E02F 3/42* (2013.01); *E02F 3/425* (2013.01); *E02F 3/46* (2013.01)

(58) Field of Classification Search
CPC ..... E02F 9/2808; E02F 9/2207; E02F 3/3677; E02F 3/40; E02F 3/46; E02F 3/42; F16F 9/15; F16F 9/36
USPC ..... 37/195, 344, 345, 398, 444–446; 414/690, 694, 695, 685, 722, 726
See application file for complete search history.

(56) References Cited

U.S. PATENT DOCUMENTS

| | | | |
|---|---|---|---|
| 2,781,926 | A | 2/1957 | Sights |
| 3,184,085 | A | 5/1965 | Randall et al. |
| 3,219,213 | A | 11/1965 | Learmont |
| 3,243,063 | A | 3/1966 | Learmont |
| 3,349,932 | A | 10/1967 | Wagner |
| 3,425,574 | A | 2/1969 | Willgrubs et al. |
| 3,452,890 | A | 7/1969 | Learmont |
| 3,465,903 | A | 9/1969 | Wilson |
| 3,485,394 | A | 12/1969 | Burkart |
| 3,485,395 | A | 12/1969 | Windahl |
| 3,648,863 | A | 3/1972 | Baron et al. |
| 3,738,513 | A | 6/1973 | Wagner |
| 3,843,095 | A | 10/1974 | Rupert |
| 3,933,260 | A | 1/1976 | Kronlokken et al. |
| 3,959,897 | A | 6/1976 | May |
| 4,150,812 | A | 4/1979 | Baron |
| 4,167,072 | A | 9/1979 | Johansson |
| 4,509,895 | A | 4/1985 | Baron |
| 5,423,654 | A | 6/1995 | Rohrbaugh |
| 5,469,647 | A | 11/1995 | Profio |
| 5,499,463 | A | 3/1996 | Profio et al. |
| 5,659,470 | A | 8/1997 | Goska et al. |
| 5,680,717 | A | 10/1997 | Bierwith |
| 5,820,074 | A | 10/1998 | Trommer et al. |
| 6,025,686 | A | 2/2000 | Wickert et al. |
| 6,219,946 | B1 | 4/2001 | Soczka |
| 6,314,667 | B1 | 11/2001 | Rife et al. |
| 6,434,862 | B1 | 8/2002 | Hren |
| 7,024,806 | B2 | 4/2006 | Suzik et al. |
| 7,152,349 | B1 | 12/2006 | Rowlands |
| 7,174,826 | B2 | 2/2007 | Kerrigan et al. |
| RE40,869 | E | 8/2009 | Leslie et al. |
| 7,658,023 | B2 | 2/2010 | Wallett |
| 8,943,714 | B2 | 2/2015 | Hren |
| 2002/0069562 | A1 | 6/2002 | Brown et al. |
| 2005/0150141 | A1 | 7/2005 | Suzik et al. |
| 2005/0163603 | A1 | 7/2005 | Kerrigan et al. |
| 2005/0193599 | A1 | 9/2005 | McCoy |
| 2007/0266601 | A1 | 11/2007 | Claxton |
| 2011/0033273 | A1 | 2/2011 | Geraghty |
| 2012/0279095 | A1 | 11/2012 | Feld et al. |

FOREIGN PATENT DOCUMENTS

| | | | |
|---|---|---|---|
| CN | 1166558 | | 12/1997 |
| CN | 2804183 | | 8/2006 |
| DE | 4434906 | | 4/1996 |
| GB | 292799 | A | 6/1928 |
| RU | 2008130138 | | 12/2010 |
| RU | 2456410 | | 7/2012 |
| SU | 164845 | | 11/1962 |
| SU | 1021723 | | 6/1983 |
| WO | 9927197 | A2 | 6/1999 |
| WO | 2010138122 | A1 | 12/2010 |
| WO | 2010140996 | A1 | 12/2010 |
| WO | 2010141007 | A1 | 12/2010 |

OTHER PUBLICATIONS

First Office Action from the Australian Intellectual Property Office for Application No. 2013200539 dated Jun. 6, 2014 (7 pages).
First Office Action from the State Intellectual Property Office of China for Application No. 201310111095.X dated Feb. 3, 2016 (21 pages).
First Office Action issued by the Russian Patent Office for Application No. 2013104082 dated Jun. 6, 2016 (8 pages).
First Office Action from the State Intellectual Property Office of China for Application No. 201310111095.X dated Sep. 30, 2016 (21 pages).

SHOVEL WITH PIVOTING BUCKET

CROSS-REFERENCE TO RELATED APPLICATIONS

This application is a continuation of prior-filed, co-pending U.S. patent application Ser. No. 13/755,228, filed Jan. 31, 2013, which claims the benefit of U.S. Provisional Patent Application No. 61/592,944, filed Jan. 31, 2012, and U.S. Provisional Patent Application No. 61/593,131, filed Jan. 31, 2012 the entire contents of both of which are incorporated herein by reference.

BACKGROUND

The present invention relates to the field of mining shovels. Specifically, the present invention relates to a rope shovel having an actively controlled bucket.

On a conventional rope shovel, a dipper is attached to a handle, and the dipper is supported by a cable, or rope, that passes over a boom sheave. The rope is secured to a bail that is pivotably coupled to the dipper. During the hoist phase, the rope is reeled in by a hoist drum, lifting the dipper upward through the bank and liberating the material to be dug. The dipper is hollow with a substantially rectangular cross-section, and the interior walls of the dipper are generally straight.

The use of the rope to hoist the dipper maximizes the lifting force during the dig cycle. However, the orientation of the dipper relative to the handle is generally fixed during a dig cycle. The operator cannot control the motion of the dipper or other attachment independent of the handle and hoist rope, limiting the ability to adjust the shovel's performance in response to variation in the digging conditions. The penetration or breakout force of the dipper is largely dependent on the hoist force and the orientation of the dipper. For example, while the hoist force is substantially vertical, the dipper is substantially horizontal with respect to the material to be dug. This significantly limits the amount of hoist force that can be transmitted to breakout force at the digging edge of the dipper. In addition, the dipper lacks versatility: in order to perform a digging operation, the dipper must typically be positioned at the base of the bank and pulled through to the top. This makes it difficult to perform selective digging, or inserting the dipper at an intermediate height of the bank and digging from that point.

SUMMARY

Clamshell buckets, as commonly used on a hydraulic excavator, include a main body and a rear wall. The main body and the rear wall are separated by actuation of bucket cylinders. The main body has a curved inner wall, which permits material to peel and slide into the bucket and fill the bucket more completely. Clamshell buckets also include straight side walls and a lower lip extending along a straight line across the top of the lower wall. The lower lip has a plurality of teeth and defines a digging edge. The digging edge ends where the lower lip meets the side walls, forming a square corner on each side. The corners increase resistance in the material to be dug, requiring greater force to penetrate the material. In addition, because each corner may experience a different resistance force, the bucket is subjected to unbalanced forces that create a torsional load laterally across the bucket. These factors increase wear on the bucket and reduce digging efficiency. Furthermore, when the rear wall and the main body are separated to discharge material, the curved inner wall results in an inner ridge that prevents material from discharging easily. This causes the main body to lift the material, increasing the load on the bucket cylinders and increasing dump times.

In one embodiment, the invention provides a mining shovel including a base, a boom, a first member moveably coupled to the boom, a bucket, and a pivot actuator. The base includes a hoist drum for paying out and reeling in a hoist rope. The boom includes a first end coupled to the base and a second end opposite the first end. The hoist rope extends over the second end of the boom. The first member includes a first end and a second end. The bucket is pivotably coupled to the second end of the first member. The pivot actuator moves the bucket relative to the second end of the first member, and the pivot actuator includes a first end coupled to the first member.

In another embodiment, the invention provides a mining shovel including a boom, a hoist rope, a handle moveably coupled to the boom, a bucket, and a pivot actuator. The boom includes a first end and a second end opposite the first end. The hoist rope extends substantially along the boom and passes over the second end of the boom. The handle is moveably coupled to the boom and includes a first end and a second end. The bucket is pivotably coupled to the second end of the handle at a wrist joint, and is coupled to the hoist rope passing over the second end of the boom. The hoist rope exerts a tension force on the bucket at a position that is offset from the wrist joint. The tension force induces a moment on the bucket to rotate the bucket about the wrist joint in a first direction. The pivot actuator includes a first end coupled to the handle. Operation of the pivot actuator causes the bucket to rotate about the wrist joint in the first direction.

In yet another embodiment, the invention provides a bucket for a digging machine. The machine includes a boom and a first member moveably coupled to the boom, and the bucket is coupled to an end of the first member. The bucket includes a pair of side walls spaced apart by a distance, a lower wall extending between the side walls, and a digging edge. The side walls and the lower wall defining a material receiving opening. The digging edge extends at least partially around the material receiving opening. The digging edge defines a continuous round profile extending between each side wall and the lower wall.

In still another embodiment, the invention provides a method for selectively digging a bank of material, the bank including a base and a peak. The method includes providing a rope shovel including a boom having a first end and a second end opposite the first end, a hoist rope extending substantially along the boom and passing over the second end of the boom, a first member moveably coupled to the boom and including a first end and a second end, and a bucket pivotably coupled to the second end of the first member and being coupled to the hoist rope passing over the second end of the boom; hoisting the bucket to a position proximate the bank of material and between the base portion and the upper portion; actuating pivot cylinders coupled between the first member and the bucket to rotate the bucket; and extending the first member to penetrate the bank of material between the base portion and the upper portion.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting.

Figure 1:
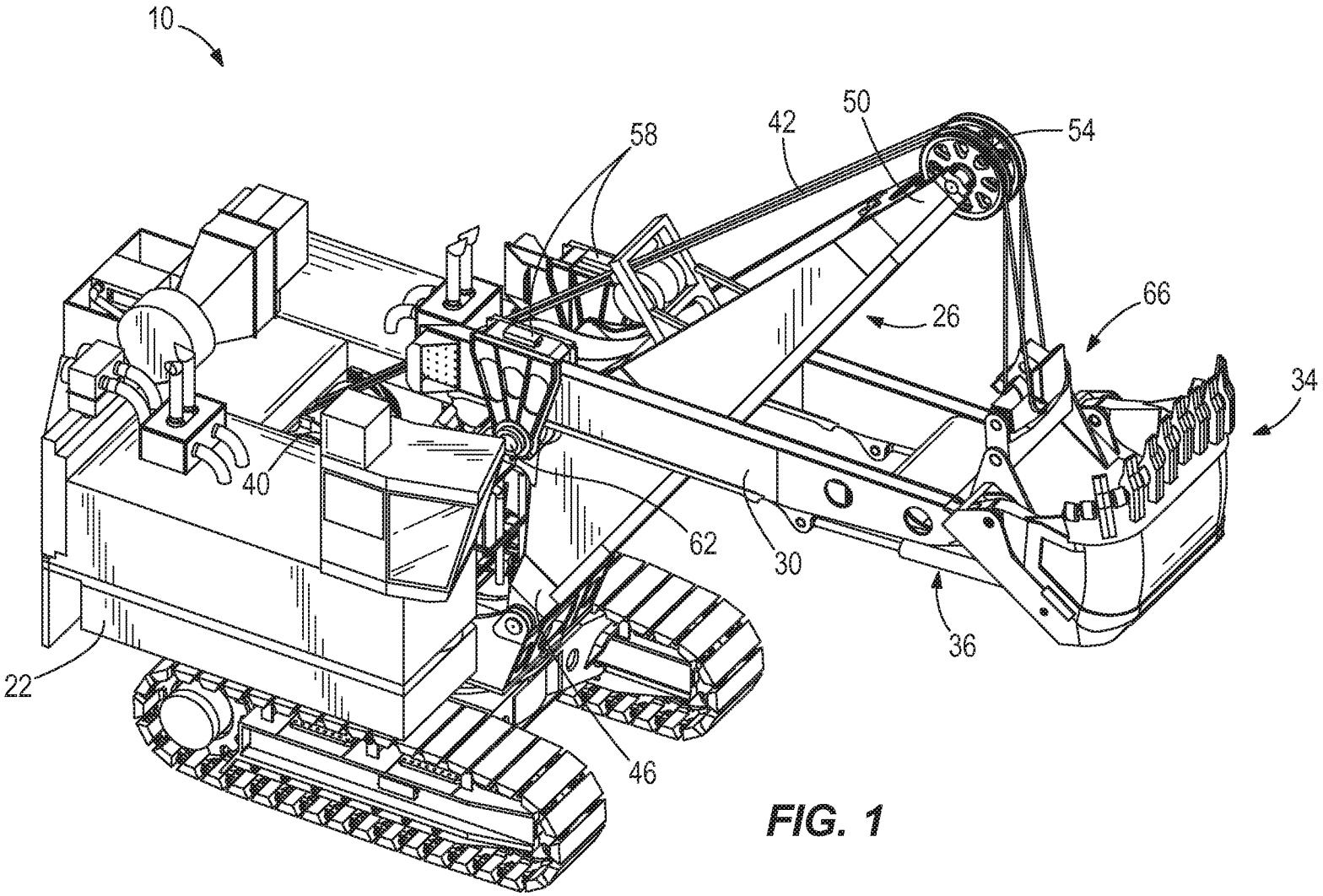
FIG. 1 is a perspective view of a mining shovel.
Figure 2:
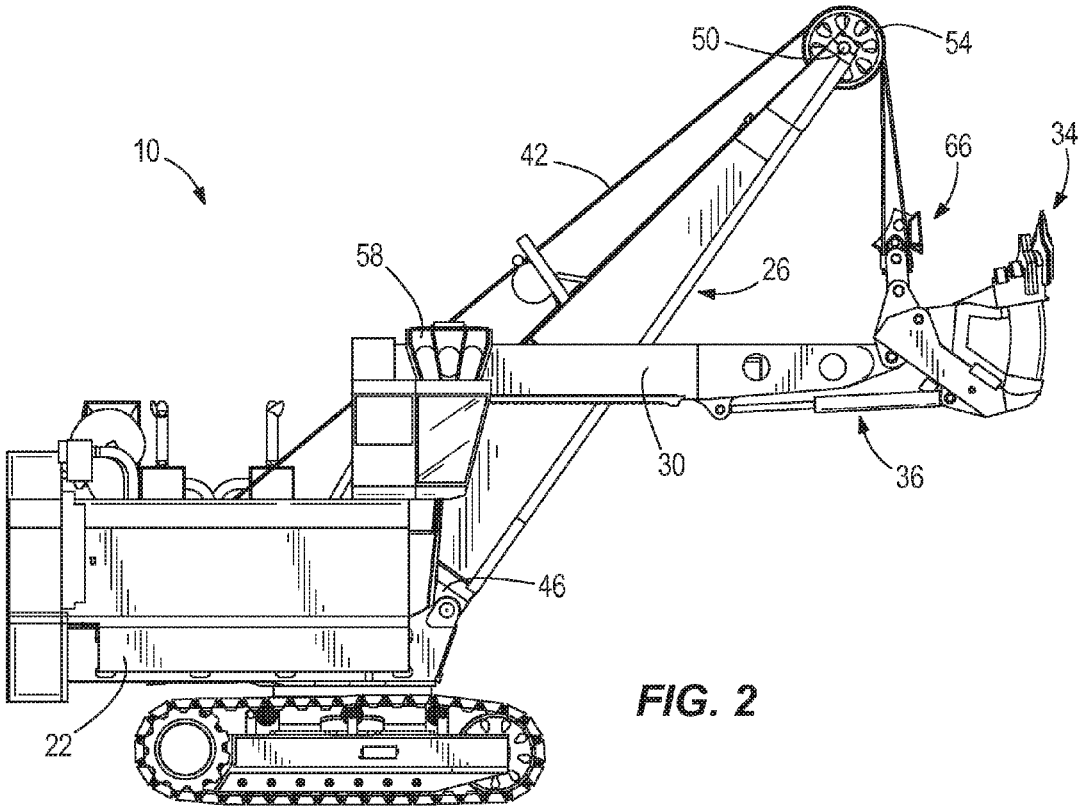
FIG. 2 is a side view of the mining shovel of FIG. 1.
Figure 6:
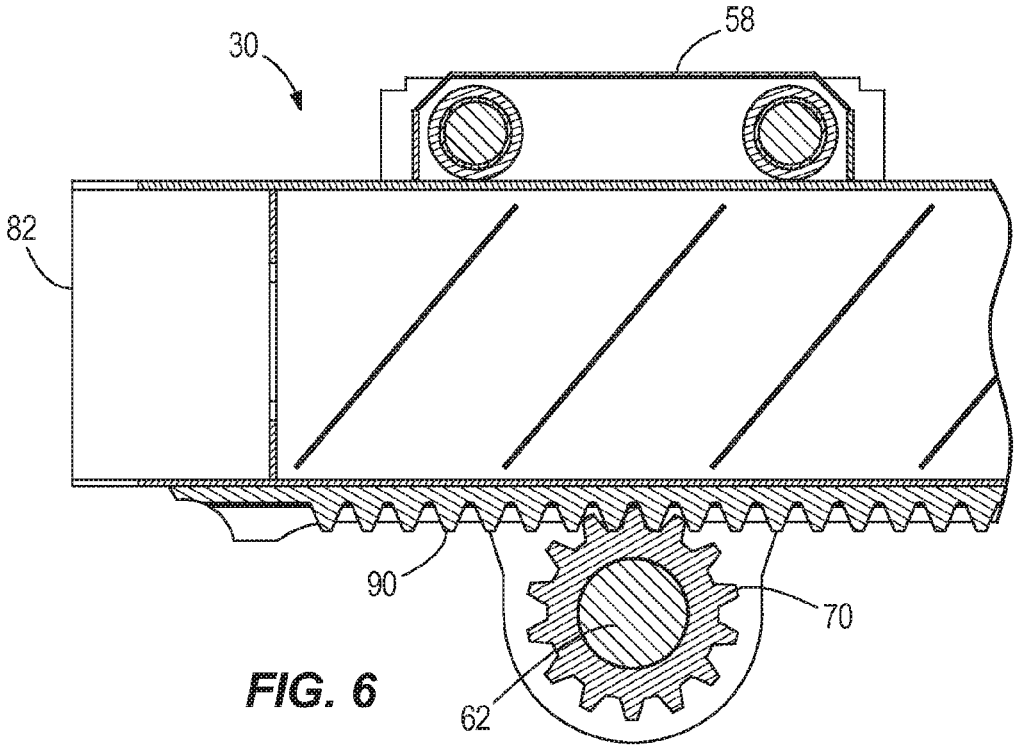
FIG. 6 is an enlarged cross-section view of the handle shown in FIG. 5.

As shown in FIGS. 1 and 2, a mining shovel 10 rests on a support surface, or floor, and includes a base 22, a boom 26, a first member or handle 30, a bucket 34, and a pivot actuator 36. The base 22 includes a hoist drum 40 (FIG. 1) for reeling in and paying out a cable, or hoist rope 42. The boom 26 includes a first end 46 coupled to the base 22, a second end 50 opposite the first end 46, a boom sheave 54, a saddle block 58, and a shipper shaft 62 (FIG. 1). The boom sheave 54 is coupled to the second end 50 of the boom 26 and guides the rope 42 over the second end 50. The rope 42 is coupled to the bucket 34 by a bail 66. The bucket 34 is raised or lowered as the rope 42 is reeled in or paid out, respectively, by the hoist drum 40. The saddle block 58 is rotatably coupled to the boom 26 by the shipper shaft 62, which is positioned between the first end 46 and the second end 50 of the boom 26 and extends through the boom 26. The shipper shaft 62 includes a spline pinion 70 (FIG. 6). The handle 30 is moveably coupled to the boom 26 by the saddle block 58.

Figure 3:
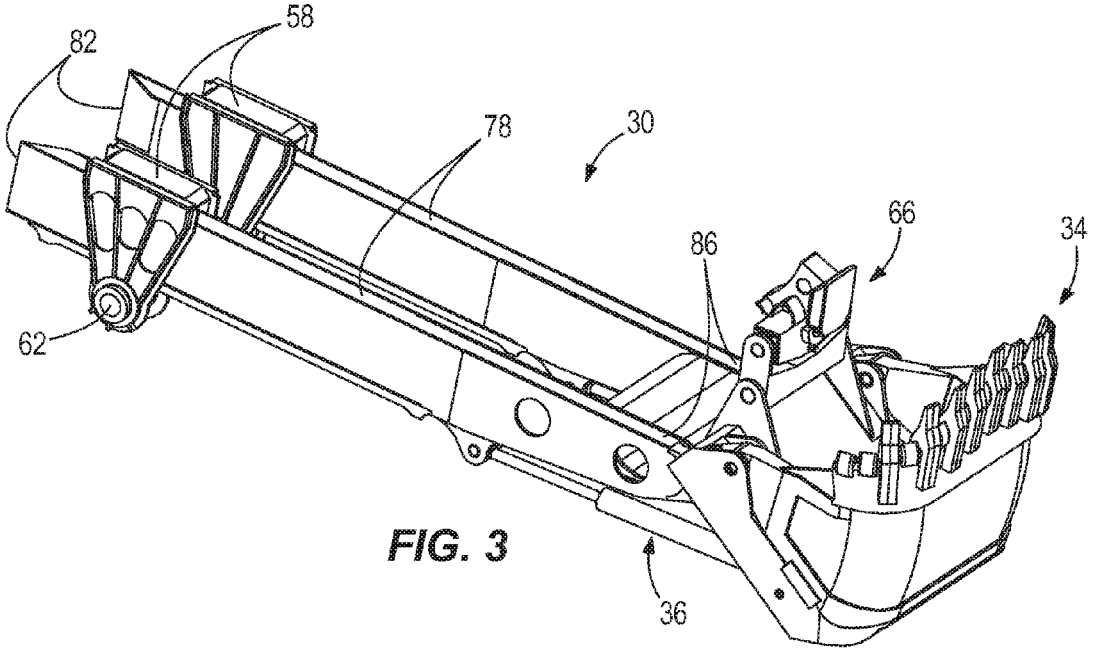
FIG. 3 is a perspective view of a handle and bucket.
Figure 4:
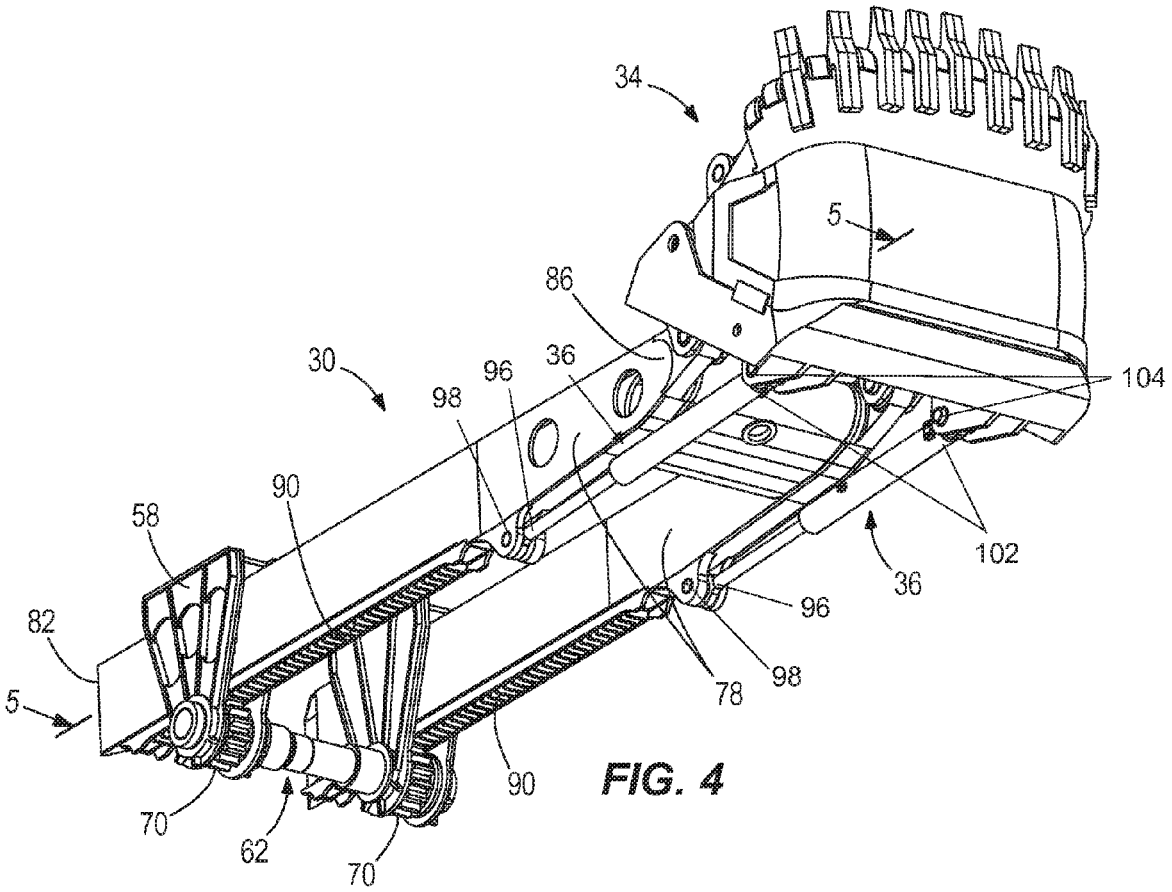
FIG. 4 is a lower perspective view of the handle and bucket of FIG. 3.
Figure 5:
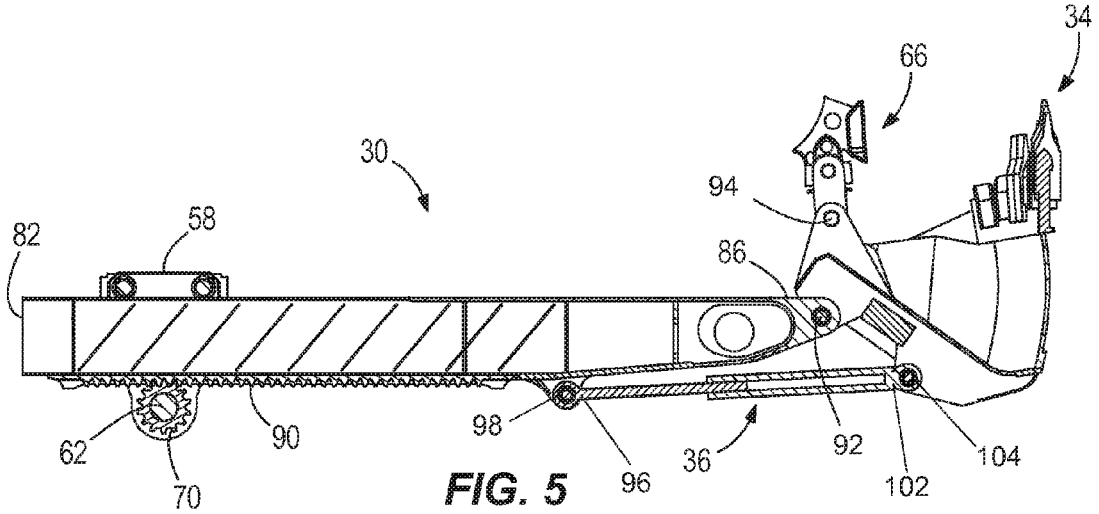
FIG. 5 is a cross-section view of the handle and bucket of FIG. 4, taken along line 5-5.

Referring to FIGS. 3 and 4, the first member or handle 30 includes a pair of arms 78 defining a first end 82, a second end 86, and a rack 90 (FIG. 4) for engaging the spline pinion 70 (FIG. 4). The first end 82 of the handle 30 is moveably received in the saddle block 58, and the handle 30 passes through the saddle block 58 such that the handle 30 is configured for rotational and translational movement relative to the boom 26 (FIG. 1). Stated another way, the handle 30 is linearly extendable relative to the saddle block 58 and is rotatable about the shipper shaft 62. In the illustrated embodiment, the handle 30 is substantially straight. In other embodiments, the handle 30 may include a curved portion. As shown in FIGS. 5 and 6, the rack 90 engages the spline pinion 70, and rotation of the shipper shaft 62 facilitates translational movement of the handle 30 via a rack and pinion mechanism.

As best shown in FIG. 5, the bucket 34 is pivotably coupled to the second end 86 of the handle 30 at a wrist joint 92. The bail 66 is coupled to the rope 42 (FIG. 1) passing over the boom sheave 54 (FIG. 1) and is pivotably coupled to the bucket 34 about a first joint, or bail joint 94. In the illustrated embodiment, the wrist joint 92 and the bail joint 94 are pin couplings. In other embodiments, the bail 66 is pivotably coupled to the handle 30. Furthermore, in the illustrated embodiment, the bail 66 is substantially similar to the bail described in U.S. patent application Ser. No. 13/691,024, filed Nov. 30, 2012, the entire contents of which are incorporated herein by reference. In still other embodiments, the bucket 34 may be coupled to another type of hoist actuator at the bail joint 94.

Figure 8:
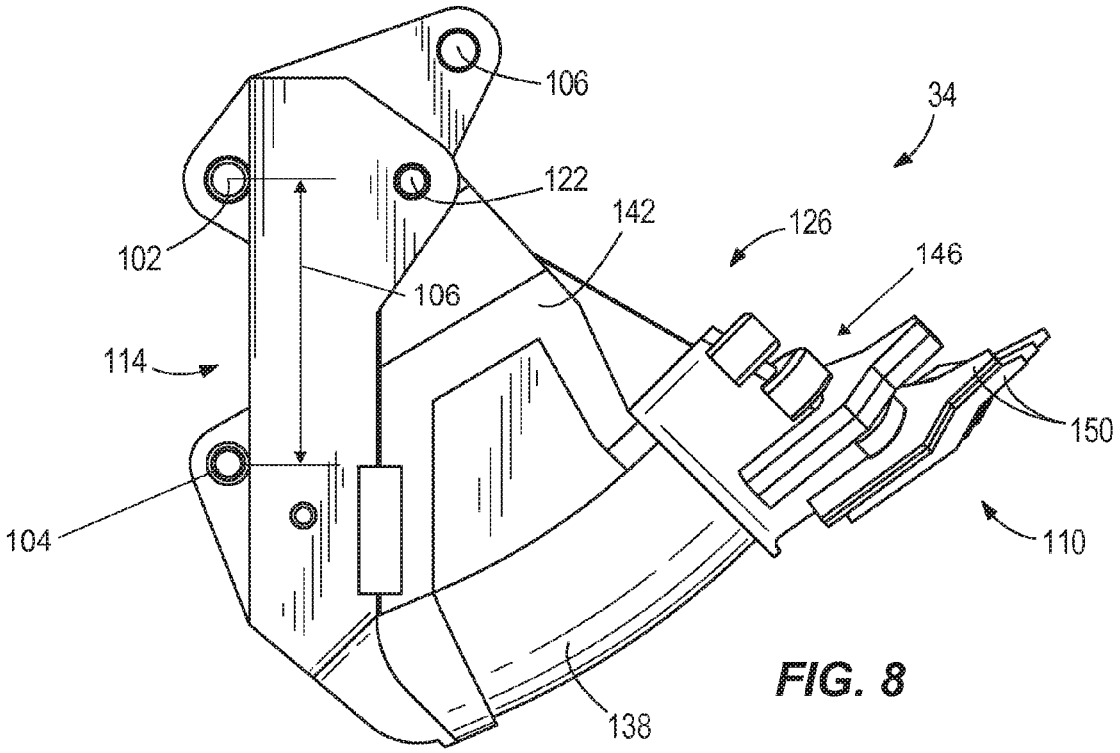
FIG. 8 is a side view of the bucket of FIG. 7.

The pivot actuator 36 controls the pitch of the bucket 34 by rotating the bucket 34 about the wrist joint 92. Referring to FIGS. 4 and 5, the pivot actuator 36 includes a first end 96 coupled to the handle 30 at a second joint 98 and a second end 102 coupled to the bucket 34 at a third joint 104. The third joint 104 is spaced apart from the wrist joint 102 by a distance 106 (FIG. 8). In the illustrated embodiment, the pivot actuator 36 includes a pair of hydraulic cylinders directly coupled between a lower portion of the handle 30 and a lower portion of the bucket 34. In other embodiments, a different type of actuator may be used. In still other embodiments, the actuator is coupled between an upper portion of the handle 30 and/or an upper portion of the bucket 34. In still other embodiments, the pivot actuator 36 is coupled to the bucket via an intermediate linkage. An intermediate linkage may include a secondary member that is pivotably coupled between the bucket 34 and the second end 102 of the actuator 36, and the secondary link may also be coupled to the handle by a ternary link. The intermediate linkage may also include a "Z-bar" arrangement in which the second end 102 of the pivot actuator 36 is coupled to one end of a link that is pivotable relative to the handle 30 and a secondary link or actuator is coupled between a second end of the pivoting link and the bucket 34.

As described above, the bucket 34 is connected to three components: 1) the second end 86 of the handle 30 at the wrist joint 92; 2) the pivot actuator 36 at the third joint 104; and 3) the hoist rope 42 at the bail joint 94. The relative positions of the wrist joint 92, the bail joint 94, the second joint 98, and the third joint 104 may be altered to optimize the behavior of the bucket 34 during a dig cycle.

Figure 7:
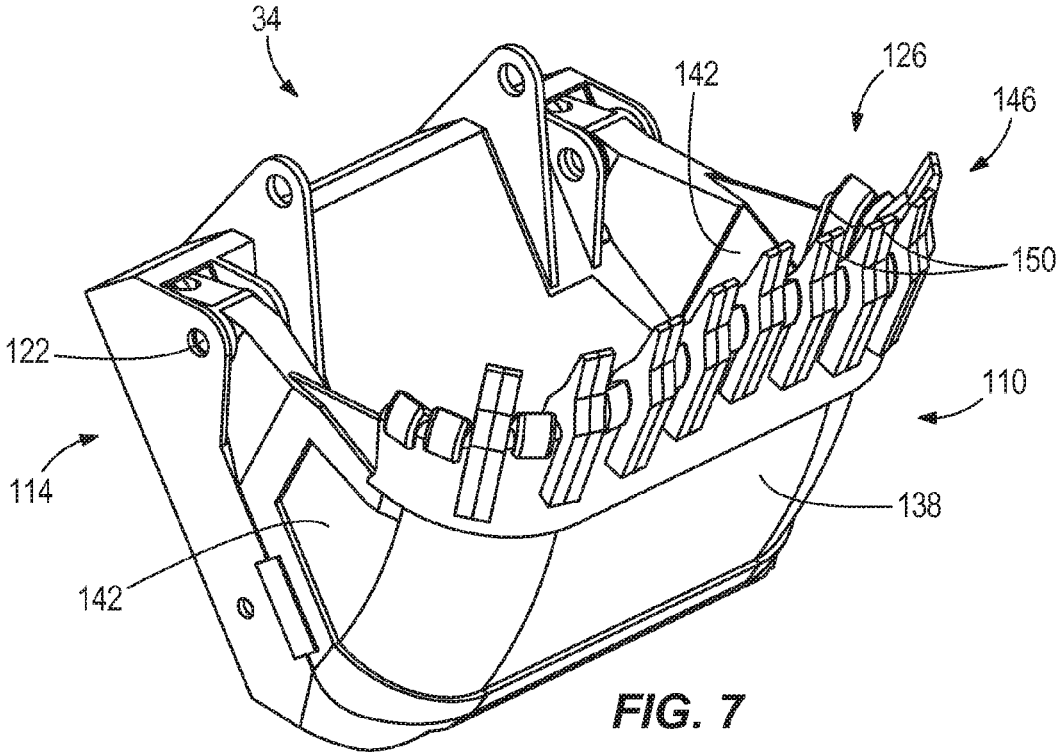
FIG. 7 is a perspective view of a bucket.
Figure 10:
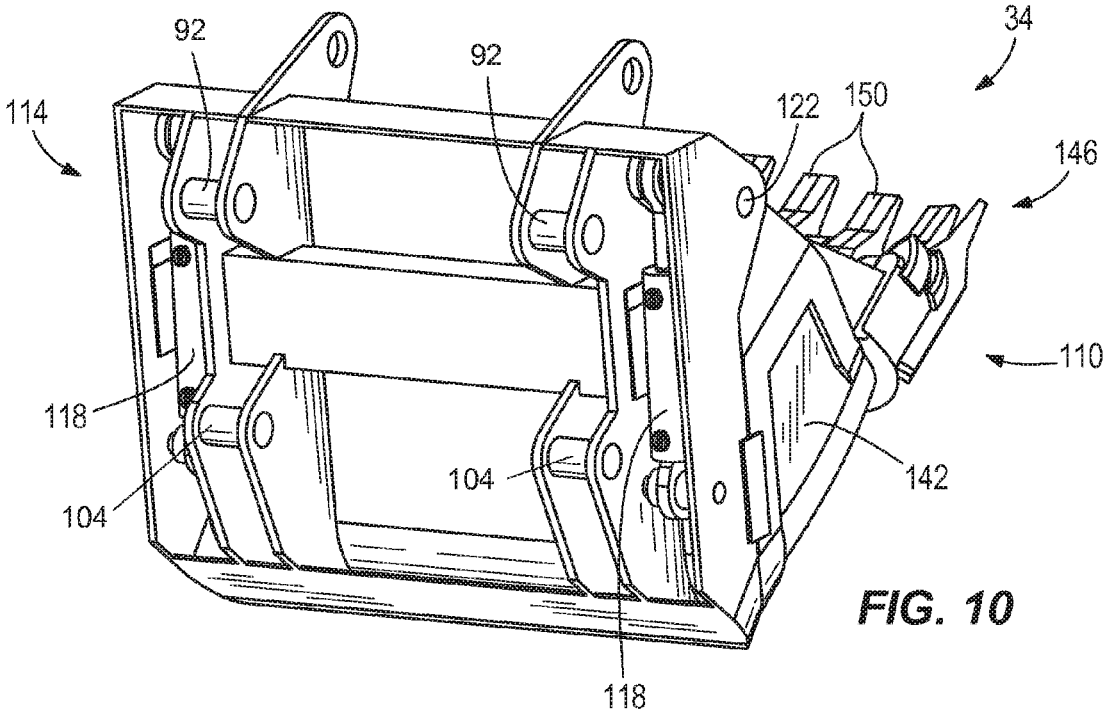
FIG. 10 is a rear perspective view of the bucket of FIG. 7.
Figure 11:
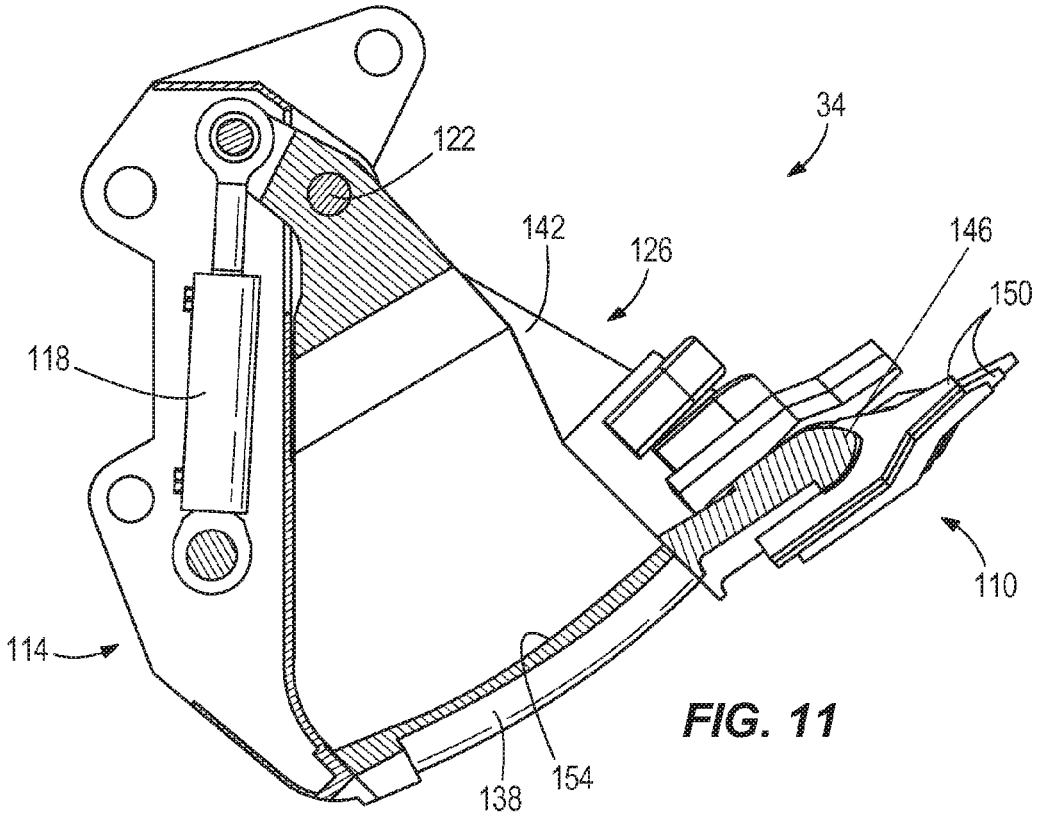
FIG. 11 is a cross-section view of the bucket of FIG. 9, taken along line 11-11, with the bucket in a closed state.
Figure 12:
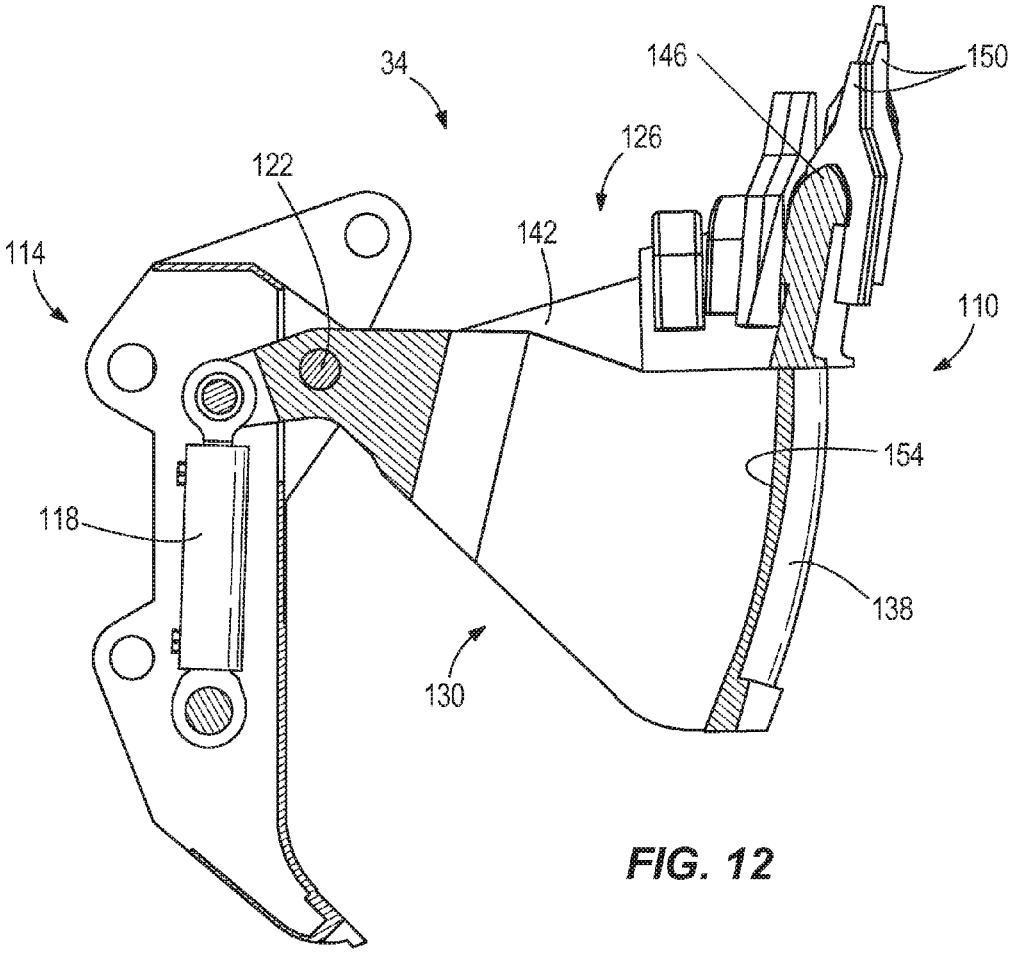
FIG. 12 is a cross-section view of the bucket of FIG. 11 with the bucket in an open state.

As shown in FIGS. 7 and 8, the bucket 34 is a clamshell-type bucket including a main body 110, an end wall or rear wall 114, and a bucket actuator 118 (FIGS. 10-12). The main body 110 is pivotably coupled to the rear wall 114 about a bucket joint 122. The main body 110 defines a material receiving opening 126 on one end and a material discharging opening 130 (FIG. 12) on an opposite end. The main body 110 includes a lower wall 138 and side walls 142 extending between the material receiving opening 126 and the material discharging opening 130 (FIG. 12), and a digging edge or lip 146 proximate the material receiving opening. In the illustrated embodiment, the side walls 142 are coupled to the rear wall 114 via the bucket joint 122.

Figure 9:
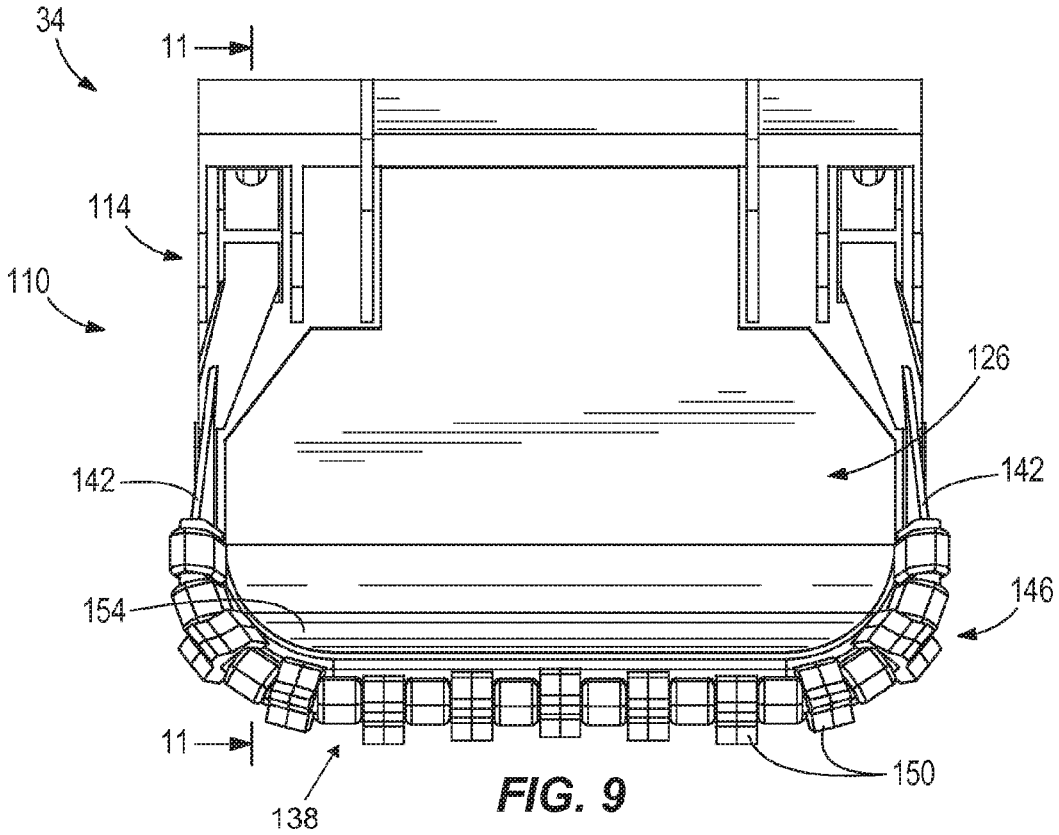
FIG. 9 is a front view of the bucket of FIG. 7.

As shown in FIG. 9, the lip 146 includes a plurality of spaced-apart teeth 150. The lip 146 forms a curved, continuous transition or profile between the lower wall 138 and the side walls 142 rather than a square corner. The curved profile of the lip 146 is positioned to engage the material to be dug and reduces torsion loads on the side walls 142. That is, the corner between each side wall 142 and the lower wall 138 is round and at least one tooth 150 is positioned along the rounded corner proximate each side wall 142. In one embodiment, the radius of the round is greater than or equal to 5% of a width of the bucket 34 as measured from one side wall 142 to the other side wall 142. The large radius profile facilitates movement of the bucket 34 through the material to be dug, increasing the digging efficiency. As best shown in FIG. 11, the lower wall 138 includes an inner surface 154 that generally forms an acute angle relative to the rear wall 114.

Referring to FIGS. 10-12, the bucket actuator 118 is coupled between the rear wall 114 and the main body 110 such that operation of the actuator 118 causes the main body 110 to rotate about the bucket joint 122, separating the main body 110 from the rear wall 114 and discharging any material contained within the bucket 34. In the illustrated embodiment, the bucket actuator 118 includes a pair of hydraulic cylinders coupled between the main body 110 and the rear wall 114 such that retraction of the cylinders causes the main body 110 and the rear wall 114 to separate.

Figure 13:
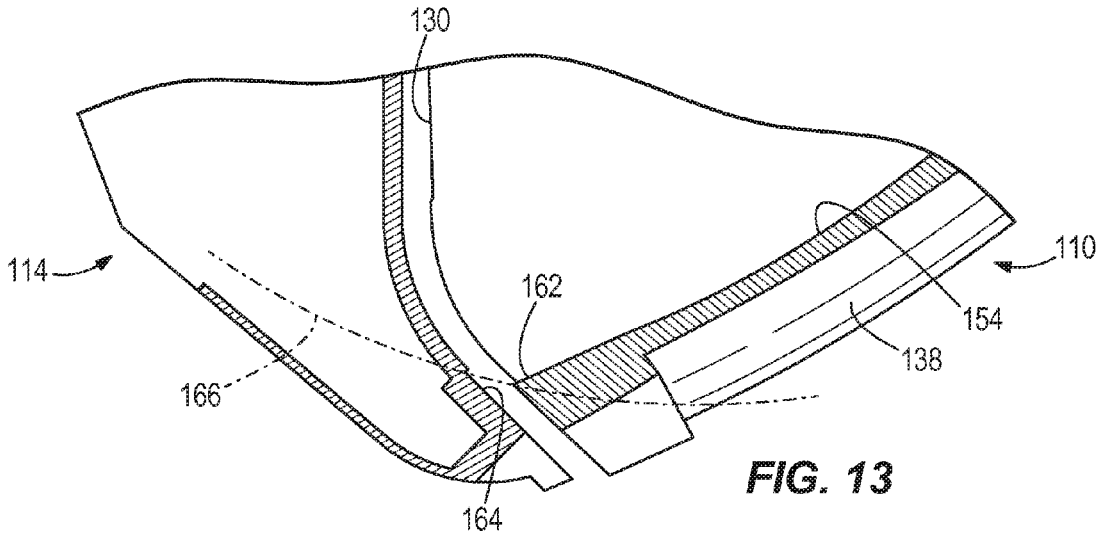
FIG. 13 is an enlarged cross-section view of the bucket of FIG. 11.

As shown in FIG. 13, the inner surface 154 of the lower wall 138 defines a discharge portion or edge 162 proximate a lower portion 164 of the rear wall 114. When the bucket 34 is closed (FIG. 11), the discharge edge 162 abuts the rear wall 114. As the bucket 34 opens, the discharge edge 162 moves away from the rear wall 114, tracing a path 166 defined by the articulation of the discharge edge 162 about the bucket joint 122 (FIG. 12). The inner surface 154 (which supports the material contained within the bucket 34) remains above the path 166 of the discharge edge 162 as the main body 110 articulates about the bucket joint 122. Stated another way, the inner surface 154 remains generally higher than the discharge edge 162 so that moving the main body 110 away from the wall 114 creates a void through which the contents of the bucket 34 falls. The discharge edge 162 facilitates discharge of the material because it does not catch or trap any of the contents of the bucket 34. This increases the efficiency of the bucket 34 and reduces the load on the bucket actuator 118 by reducing the weight of material that the main body 110 supports when the bucket 34 is opened (FIG. 12).

Figure 14:
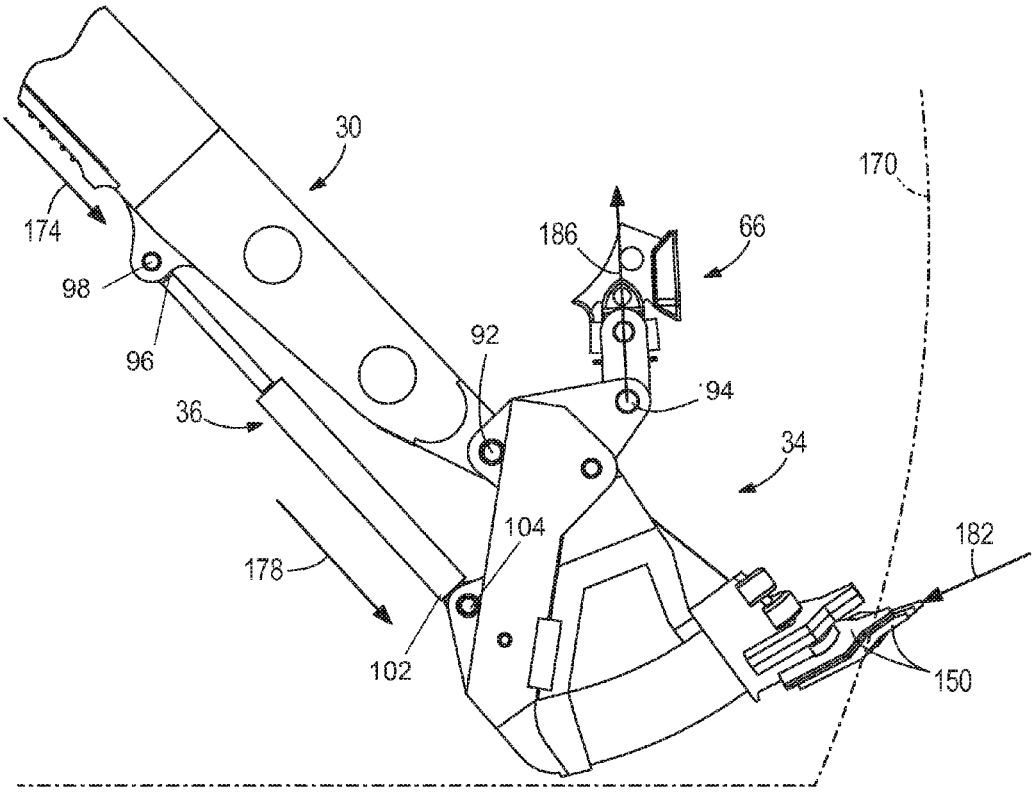
FIG. 14 is a side view of the handle and bucket of FIG. 3 during a crowd operation.
Figure 15:
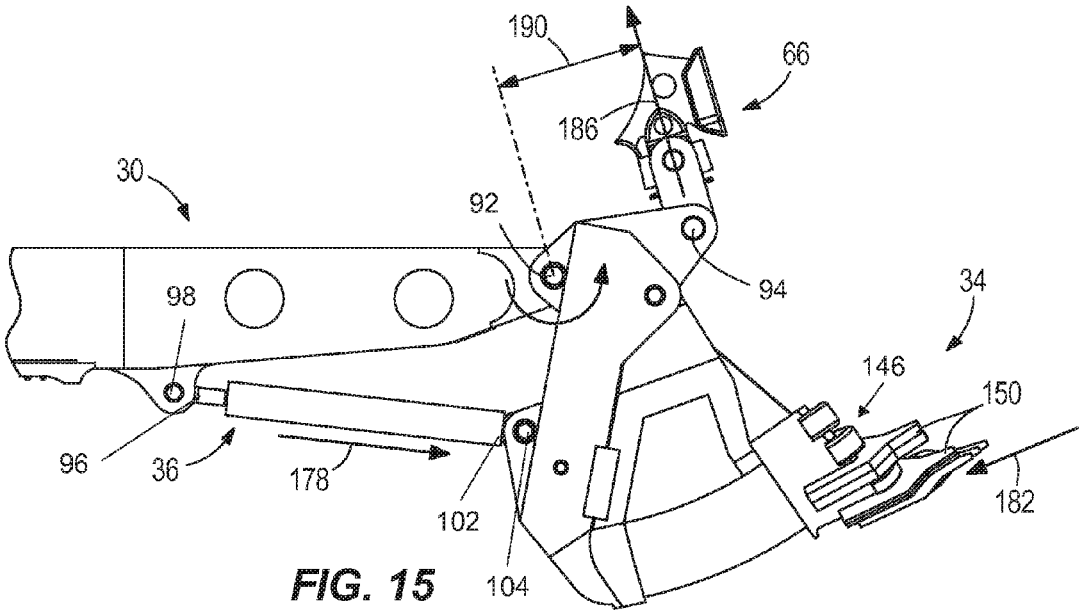
FIG. 15 is a side view of the handle and bucket of FIG. 3 during a digging operation, with a pivot actuator retracted.
Figure 16:
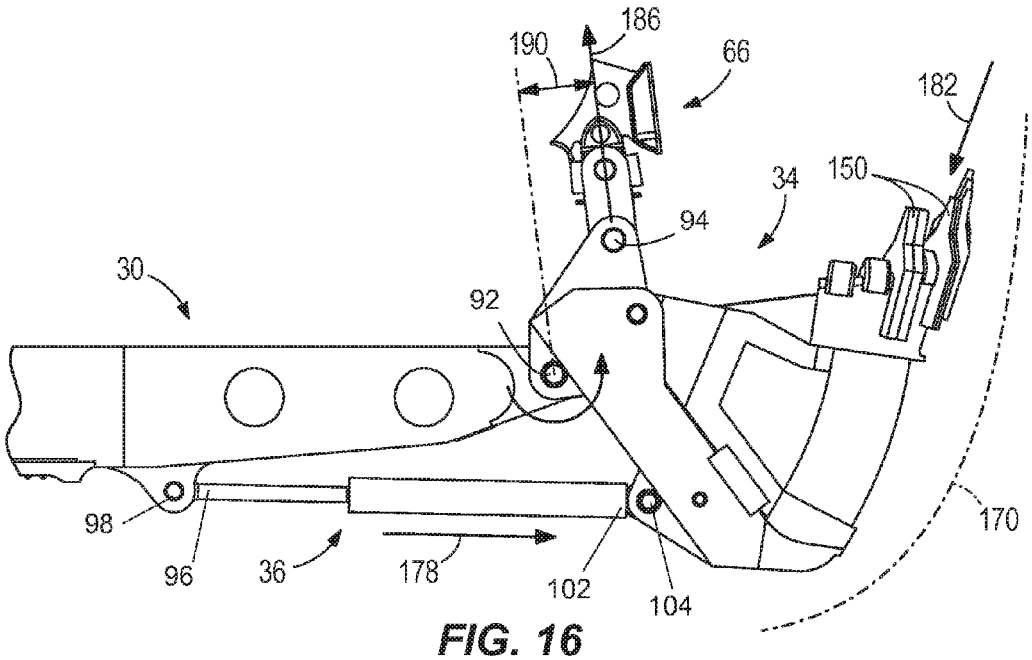
FIG. 16 is a side view of the handle and bucket of FIG. 3 during a digging operation, with a pivot actuator extended.

As shown in FIGS. 14-16, during a dig cycle, the operator extends, or crowds, the handle 30 into a bank of material 170 (FIG. 14) to be dug, exerting a crowd force 174 (FIG. 14) on the bucket 34. The operator extends the pivot actuator 36, exerting a pivot force 178 at the third joint 104 to rotate the bucket 34 about the wrist joint 92. The bank 170 exerts a reaction force 182 on the teeth 150. The reaction force 182 creates a moment about the wrist joint 92 to rotate the bucket in a first direction (clockwise in the embodiment of FIG. 14). The reaction force 182 is a compressive load working against the pivot force 178, which drives the bucket 34 about the wrist joint 92 in a second direction opposite the first direction (i.e., counter-clockwise in the embodiment of FIG. 14) to penetrate the bank 170. In addition, the hoist rope 42 (FIG. 1) exerts a hoist force 186 that acts along the hoist rope 42 (FIG. 1).

As shown in FIG. 15, the hoist force 186 is offset from the wrist joint 92 by a distance 190. This creates a moment about the wrist joint 92 acting in a second direction opposite the moment created by the reaction force 182 (i.e., counter-clockwise in FIG. 14). The hoist force 186 therefore supplements the pivot force 178 in penetrating the bank 170. The reaction force 182 of the bank 170 creates a moment on the wrist joint 92 that is proportional to the distance between the digging edge 146 and the wrist joint 92. A breakout force opposes this moment and is proportional to the sum of the hoist force 186 acting at a distance 190 from the wrist joint 92 and the pivot force 178 acting at a distance 106 (FIG. 8) from the wrist joint 92.

Referring to FIGS. 15 and 16, as the bucket 34 moves through the bank 170 (FIG. 16), the operator rotates the bucket 34 toward a more vertical orientation (FIG. 16), and the reaction force 182 of the bank 170 decreases. As the bucket 34 rotates, the offset distance 190 between the hoist force 186 and the wrist joint 92 also decreases, reducing the rotational moment about the wrist joint 92. The hoist force 186 assists in lifting the bucket 34 through the bank 170. The operator then positions the bucket 34 over a desired dump location and actuates the bucket actuator 118 (FIG. 10). This causes the main body 110 to pivot about the bucket joint 122, separating the main body 110 from the rear wall 114 and discharging the material (FIG. 10).

In addition, the pivot force 178 generally acts on the lower portion 164 of the rear wall 114. This is advantageous when the bucket 34 is resting on the ground because extending the pivot actuator 36 causes the bucket 34 to pivot against the ground. In this condition, the lower portion 164 of the bucket 34 acts as a fulcrum, essentially prying the teeth 150 into the bank 170 and allowing full utilization of the hoist force 186 reacting about the wrist joint 92.

Because the pitch of the bucket 34 is actively controlled by the pivot actuator 36, the bucket 34 may be inserted in the bank 170 at virtually any height. The breakout force of the bucket 34 is driven by the pivot force 178 and the hoist force 186, instead of being almost entirely dependent on the hoist force 186 provided by the tension in the rope 42. This eliminates the need for the operator to re-position the bucket 34 at the base of the bank 170 to initialize each dig cycle. Rather, the operator can selectively dig the bank 170.

The combination of the bucket 34 coupled to both the pivot actuator 36 and the hoist rope 42 via the bail 66 takes advantage of the hoist force 186 to increase the breakout force of the bucket 34 at the entry point into the bank 170 while maintaining the advantageous lifting force of the hoist rope 42 during the hoist phase. The combination also provides a prying motion of the bucket 34, increasing the breakout force at the base of the bank 170. Furthermore, the ability to selectively dig the bank 170 improves the versatility of the shovel 10.

In addition, the continuous curved lip 146 eliminates the square corners in the profile of the bucket 34. This reduces the resistance of the material at the sides 142 of the bucket 34, therefore reducing the force required to penetrate the bank 170. In addition, this provides a more balanced loading condition on the bucket 34, which reduces the torsional load on the bucket 34 and decreases wear on the bucket 34. Overall, these features increase the digging efficiency and the working life of the bucket 34. Furthermore, the angled inner surface 154 of the main body 110 facilitates discharge of the material from the bucket 34. This feature reduces the load on the bucket actuator 118, reduces the amount of time it takes to dump the material, and reduces the possibility of material binding the bucket 34 by becoming caught between the main body 110 and the rear wall 114.

Although the invention has been described in detail with reference to certain preferred embodiments, variations and modifications exist within the scope and spirit of one or more independent aspects of the invention as described.

Thus, the invention provides, among other things, a shovel with a pivoting bucket. Various features and advantages of the invention are set forth in the following claims.

I claim:

1. A digging assembly for a rope shovel, the rope shovel including a boom having an end, the rope shovel further including a hoist rope extending along the boom and passing over the end of the boom, the digging assembly comprising:

a handle including a first end and a second end, the handle configured to be supported for rotational movement and translational movement relative to the boom;

a bucket configured to be supported by an end of the hoist rope passing over the end of the boom, the bucket including a wall and a main body, the wall having a first side and a second side, the first side pivotably coupled to the second end of the handle at a wrist joint, the main body defining a material receiving opening and a material discharging opening, the main body pivotably coupled to the second side of the wall to selectively close the material discharging opening; and a pivot actuator for moving the bucket relative to the second end of the handle, the pivot actuator including a first end coupled to the handle and a second end coupled to the wall of the bucket.

2. The digging assembly of claim 1, wherein the hoist rope exerts a tension force on the bucket at a position that is offset from the wrist joint, the tension force inducing a moment on the bucket in a first direction about the wrist joint.

3. The digging assembly of claim 2, wherein the pivot actuator is a hydraulic cylinder and the second end of the pivot actuator is coupled to the wall at a second joint offset from the wrist joint, extension of the cylinder causing the bucket to rotate about the second end of the first member in the first direction.

4. The digging assembly of claim 1, wherein the main body includes a pair of side walls and a lower wall extending between the side walls, the side walls spaced apart by a bucket width, the main body defining a digging edge extending at least partially around the material receiving opening, the digging edge defining a continuous round profile extending between each side wall and the lower wall.

5. The digging assembly of claim 4, wherein the bucket further includes a plurality of teeth positioned along the length of the digging edge.

6. The digging assembly of claim 4, wherein the round profile extending between the side wall and the lower wall has a radius that is at least 5% of the bucket width.

7. The digging assembly of claim 1, further comprising a bucket actuator including a first end coupled to the wall and a second end coupled to the main body such that operation of the bucket actuator causes the main body to pivot relative to the wall.

8. The digging assembly of claim 2, wherein actuation of the pivot actuator changes an offset distance between the tension force and the wrist joint, thereby changing the moment induced by the tension force.

9. The digging assembly of claim 1, further comprising a bail pivotably coupled to the wall of the bucket, the bail configured to be coupled to the end of the hoist rope.

10. The digging assembly of claim 1, wherein the handle includes a pair of arms extending between the first end and the second end, wherein the pivot actuator includes a first hydraulic cylinder and a second hydraulic cylinder, the first hydraulic cylinder coupled between one of the pair of arms and the wall, the second hydraulic cylinder coupled between the other of the pair of arms and the wall.

11. The digging assembly of claim 1, wherein the pivot actuator is coupled between a lower surface of the handle and a lower portion of the wall.

12. The digging assembly of claim 1, wherein the second side of the wall includes a first edge and a second edge, wherein the main body is pivotably coupled to the wall at a bucket joint positioned proximate the first edge, the main body including a discharge portion positioned adjacent the second edge of the wall when the main body is closed against the wall, wherein the second edge has a curved profile extending away from the first side of the wall.

13. A digging attachment for a rope shovel, the rope shovel including a boom, a hoist rope, and a handle, the boom having an end, the hoist rope extending along the boom and passing over the end of the boom, the handle supported for translational and rotational relative to the boom, the digging attachment comprising:

a wall defining a first side and a second side opposite the first side, the first side including a wrist joint configured to be pivotably coupled to an end of the handle;

a main body pivotably coupled to the second side of the wall, the main body defining a material receiving opening and a material discharging opening;

a pivot actuator for moving the wall relative to the end of the handle, the pivot actuator including a first end configured to be coupled to the handle and a second end coupled to the wall; and a bucket actuator including a first end coupled to the wall and a second end coupled to the main body, operation of the bucket actuator causing the main body to pivot relative to the wall to selectively close the material discharging opening.

14. The digging attachment of claim 13, wherein the main body includes a pair of side walls and a lower wall extending between the side walls, the side walls spaced apart by a bucket width, the main body defining a digging edge extending at least partially around the material receiving opening, the digging edge defining a continuous round profile extending between each side wall and the lower wall.

15. The digging attachment of claim 13, wherein the hoist rope exerts a tension force on the wall at a position that is offset from the wrist joint, the tension force inducing a moment on the wall in a first direction about the wrist joint.

16. The digging attachment of claim 15, wherein actuation of the pivot actuator changes an offset distance between the tension force and the wrist joint, thereby changing the moment induced by the tension force.

17. The digging attachment of claim 13, further comprising a bail pivotably coupled to the wall, the bail configured to be coupled to the end of the hoist rope.

18. The digging attachment of claim 13, wherein the bucket actuator is a hydraulic cylinder, extension of the hydraulic cylinder causing the main body to move toward a position in which the material discharging opening is closed.

19. The digging attachment of claim 13, wherein the pivot actuator is a hydraulic cylinder and the second end of the pivot actuator is coupled to the wall at a second joint offset from the wrist joint, extension of the cylinder causing the wall and main body to rotate about the wrist joint in a first direction.

20. The digging attachment of claim 14, wherein the round profile extending between the side wall and the lower wall has a radius that is at least 5% of the bucket width.

21. The digging attachment of claim 13, wherein the pivot actuator includes a pair of hydraulic cylinders, each of the cylinders including a first end and a second end, the first end configured to be coupled to a lower surface of the handle, the second end coupled to the first side of the wall at a second joint offset from the wrist joint, extension of the cylinder causing the wall to rotate about the wrist joint.

22. The digging attachment of claim 13, wherein the pivot actuator is coupled between a lower surface of the handle and a lower portion of the wall.

23. The digging attachment of claim 13, wherein the second side of the wall includes a first edge and a second edge, wherein the main body is pivotably coupled to the wall at a bucket joint positioned proximate the first edge, the main body including a discharge portion positioned adjacent the second edge of the wall when the main body is closed against the wall, wherein the second edge has a curved profile extending away from the first side of the wall.

24. A digging attachment for a rope shovel, the rope shovel including a boom, a hoist rope, and a handle, the boom having an end, the hoist rope extending along the boom and passing over the end of the boom, the handle supported for translational and rotational relative to the boom, the digging attachment comprising:

a wall defining a first side and a second side opposite the first side, the first side including a wrist joint configured to be pivotably coupled to an end of the handle;

a main body pivotably coupled to the second side of the wall, the main body defining a material receiving opening and a material discharging opening; and a bail pivotably coupled to one of the wall and the main body, the bail configured to be coupled to an end of the hoist rope to support the digging attachment relative to the end of the boom.

25. The digging attachment of claim 24, wherein the bail is pivotably coupled to the wall.

26. The digging attachment of claim 24, further comprising a pivot actuator for moving the wall relative to the end of the handle, the pivot actuator includes a pair of hydraulic cylinders, each of the cylinders including a first end and a second end, the first end configured to be coupled to a lower surface of the handle, the second end coupled to the first side of the wall at a second joint offset from the wrist joint, extension of the cylinder causing the wall to rotate about the wrist joint.

27. The digging attachment of claim 24, wherein the second side of the wall includes a first edge and a second edge, wherein the main body is pivotably coupled to the wall at a bucket joint positioned proximate the first edge, the main body including a discharge portion positioned adjacent the second edge of the wall when the main body is closed against the wall, wherein the second edge has a curved profile extending away from the first side of the wall.

28. The digging attachment of claim 24, wherein the hoist rope exerts a tension force on the digging attachment through the bail at a position that is offset from the wrist joint.

29. The digging attachment of claim 28, further comprising a pivot actuator for moving the wall relative to the end of the handle, wherein the tension force induces a moment on the wall in a first direction about the wrist joint, wherein actuation of the pivot actuator changes an offset distance between the tension force and the wrist joint and thereby changes the moment induced by the tension force.

30. The digging attachment of claim 29, wherein the pivot actuator is a hydraulic cylinder including a first end configured to be coupled to the handle and a second end, the second end coupled to the wall at a second joint offset from the wrist joint, extension of the cylinder causing the wall to rotate about the wrist joint in the first direction.

31. The digging attachment of claim 24, further comprising a bucket actuator including a first end coupled to the wall and a second end coupled to the main body, operation of the bucket actuator causing the main body to pivot relative to the wall to selectively close the material discharging opening.

32. The digging attachment of claim 24, wherein the main body includes a pair of side walls and a lower wall extending between the side walls, the side walls spaced apart by a bucket width, the main body defining a digging edge extending at least partially around the material receiving opening, the digging edge defining a continuous round profile extending between each side wall and the lower wall.

33. The digging attachment of claim 32, wherein the round profile extending between the side wall and the lower wall has a radius that is at least 5% of the bucket width.

* * * * *